United States Patent [19]

Wright, Jr. et al.

[11] Patent Number: 4,728,055

[45] Date of Patent: Mar. 1, 1988

[54] YARN PACKAGE HOLDER

[76] Inventors: Joe Wright, Jr., P.O. Box 6763; Lang S. Ligon, P.O. Box 5578, Station B, both of Greenville, S.C. 29606

[21] Appl. No.: 931,266

[22] Filed: Nov. 17, 1986

[51] Int. Cl.[4] ..... B65H 49/04

[52] U.S. Cl. ..... 242/130; 242/129.7; 242/131

[58] Field of Search ..... 242/130, 130.1, 130.2, 242/130.3, 130.4, 131, 131.1, 129.5, 129.7

[56] References Cited

U.S. PATENT DOCUMENTS

| | | | |
|---|---|---|---|
| 1,233,064 | 7/1917 | Kretzschmar | 242/130 |
| 1,508,105 | 9/1924 | Kamla | 242/130.1 X |
| 1,675,241 | 6/1928 | Bacon et al. | 242/130.1 |
| 1,805,495 | 5/1931 | McKean | 242/129.7 |
| 2,272,120 | 2/1942 | Javery et al. | 242/129.7 |
| 2,283,373 | 5/1942 | Krafft | 242/130.1 X |
| 2,437,888 | 3/1948 | Narki | 242/129.7 X |
| 2,546,301 | 3/1951 | Garden et al. | 242/130.1 |

FOREIGN PATENT DOCUMENTS

| | | | |
|---|---|---|---|
| 1043774 | 11/1958 | Fed. Rep. of Germany | 242/130 |
| 408762 | 4/1934 | United Kingdom | 242/130 |

*Primary Examiner*—Stanley N. Gilreath
*Attorney, Agent, or Firm*—Cort Flint

[57] ABSTRACT

A holder (18) for receiving and frictionally securing yarn package (12) wound onto tubes of various inner diameters is disclosed. The holder comprises a base support which includes an arm (20) adapted to be attached to the textile machine. Extending at a right angle from the base arm is a cantilever contact arm 24 which is rigidly connected to the base. The contact arm has a contoured support arm (28) pivotally connected to its free end and extending alongside the contact arm to a point near the base support. A spring (34) is interposed between the contact arm (24) and the contoured support arm (28) and urges them apart, and against the inner walls of a yarn tube (13) placed about the contact arm and the contoured support arm.

16 Claims, 5 Drawing Figures

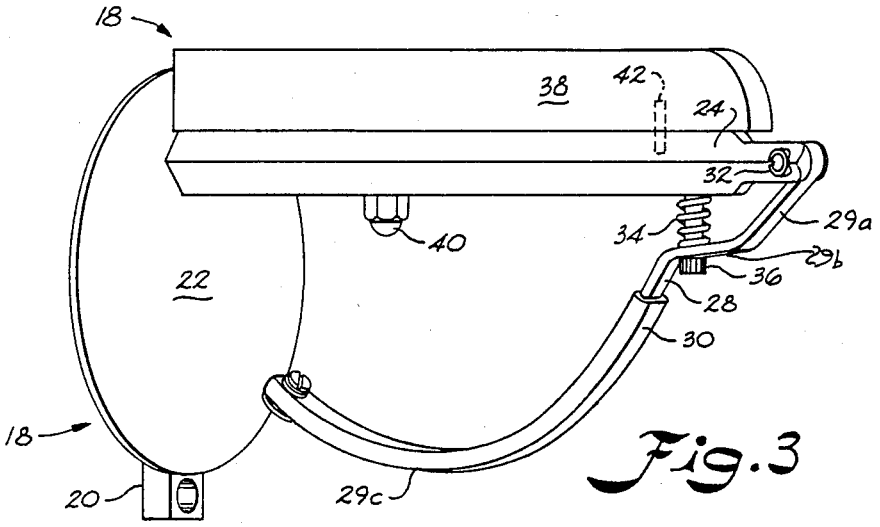
Fig. 3
Fig. 4
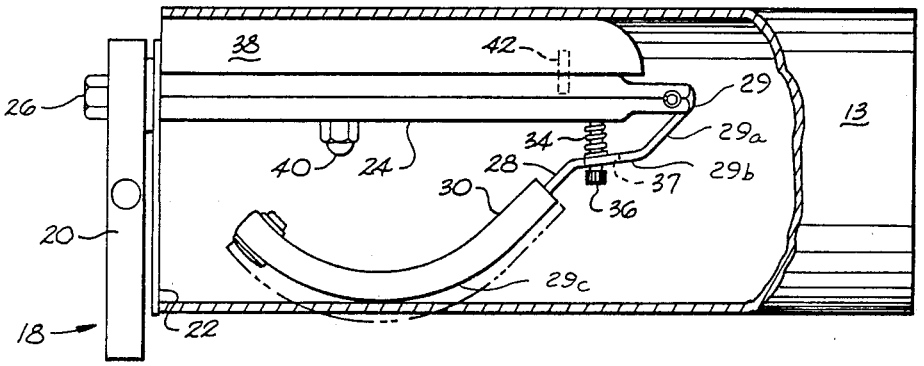
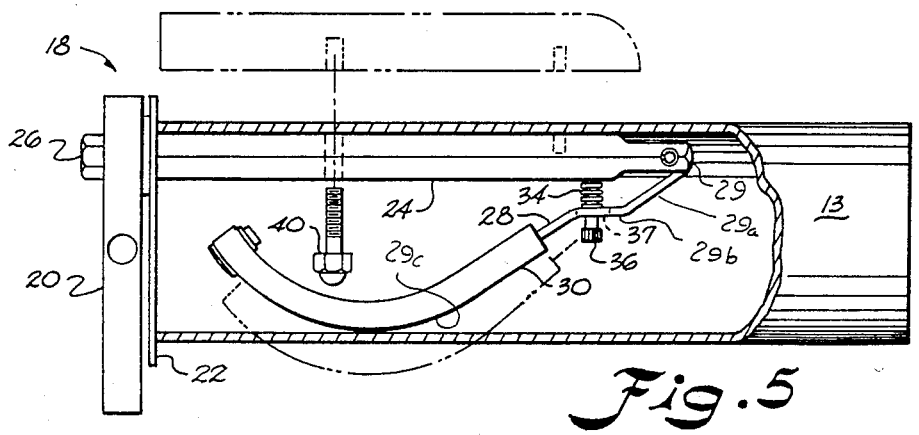
Fig. 5

YARN PACKAGE HOLDER

BACKGROUND OF THE INVENTION

This invention pertains to a yarn package holder for textile machines and, more particularly, to an improved type weft yarn package holder for so-called outside filling supply or shuttle-less looms.

In looms of the outside filling supply type, that is, those looms in which the weft yarn is supplied from an outside source and is not carried to and fro through the warp shed by the shuttle or carrier itself, it is common practice to utilize a creel on one side of the loom to support and position weft packages from which the required weft yarn is withdrawn during operation of the loom.

Supports for yarn packages, where the yarn is wound onto a hollow tube, in which an adjustable or elastic holding device, provided at the middle of the tube holder, engages the inner wall of the tube are known. The existing supports, however, exhibit several disadvantages. One disadvantage is that in some types of support the support is firmly attached to the tube. Another disadvantage is that many of the existing adjustable supports are provided with complicated adjusting mechanisms which make their manufacture very expensive; so much so that from an economic standpoint alone, it prevents their being used extensively in the textile industry. One such adjustable support device is found in U.S. Pat. No. 3,850,394, issued Nov. 26, 1974, to Raasch et al. This patent discloses a yarn package holder for receiving and securing a conical or cylindrical tube. This patent discloses a very complicated device for expanding a series of levers inside of the package to clamp or to hold the package on the support. As pointed out above, the mechanism shown in this patent is very complex and difficult for the operator to operate.

Another adjustable support for yarn packages is shown in U.S. Pat. No. 3,744,735 issued July 10, 1973, to Alfred Koenig. The yarn holder of this patent is embodied in an adjustable support comprising a spool holder provided with a shaft which at its free end has an external screw thread. A plurality of holding devices, slideably surround the shaft. Each of the holding devices comprises two longitudinally spaced annular portions which are connected with one another at their outer peripheries by a plurality of outwardly bowed spring layers. A nut engages the external screw thread of the shaft and abuts one of the annular portions of the holding device. As the nut is turned down on the shaft, the axial length of the holding device is decreased and the extent to which the spring layers are outwardly bowed is increased. The bobbin support may thus be adjusted to the shape of the tube so that it can support and hold the bobbin securely. Each holder comprises several of the spring-loaded holding devices. One disadvantage of this holding device is that it must be manually adjusted for each different diameter tube utilized thereon, and no means is provided for maintaining the yarn package in a fixed position relative to the creel on which it is supported. For example, the yarn package may become skewered on the support, thereby causing problems when the yarn is withdrawn at high linear speeds by the loom.

It is, therefore, a general object of the present invention to provide a yarn package support or holder which is readily adjustable to receive and secure packages wound on hollow tubes of various diameters without the necessity of adjusting the holding device.

A more specific object of the invention is to provide a yarn package support or holder which will receive and secure yarn packages wound on hollow cylindrical tubes of various diameters and to maintain the packages' orientation during the unwinding operation on the loom with respect to the creel.

SUMMARY OF THE INVENTION

A further object of the invention is the provision of a yarn package holder on which a yarn package may easily be placed or removed manually with the use of but a single hand.

The invention is embodied in a holder for receiving and frictionally securing packages of yarn wound onto hollow tubes of various inner diameters which includes a base support arm which is adapted to be attached to the creel of the loom. A contact arm for contacting the inside wall of the tube on which the yarn is wound is connected at one end to the base support arm and extends therefrom at an angle of about ninety degrees. A contoured support arm is pivotally connected to the contact arm at a point which is remote from where the end of the contact arm is connected to the base support arm. Spring means are interposed between the contact arm and the contoured support arm which urge the end of the contoured support arm away from the contact arm and against an inside wall of a hollow tube placed around the contact arm and the contoured support arm. The shape of the contoured arm is such as to permit it to frictionally engage and secure hollow tubes of various diameters. This support will support tubes of various inner diameters without requiring any adjustment in the holding mechanism itself.

BRIEF DESCRIPTION OF THE DRAWINGS

The novel features which are considered as characteristic of the invention are set forth in particular in the claims appended to this application. The invention itself, however, both as to its construction and to its method of operation, together with additional objects and advantages thereof, will be best understood from the following description of a specific embodiment when read in connection with the accompanying drawings.

FIG. 3 is a perspective view of the yarn package holder of the invention, with the tube removed;

FIG. 4 is a side view of the holder illustrated in FIG. 3, showing a tube supported by the holding mechanism with parts of the tube broken away for clarity; and FIG. 5 is a view similar to that shown in FIG. 4, but wherein the holder has been modified to receive smaller cylindrical tubes.

DETAILED DESCRIPTION OF THE INVENTION

Figure 1:
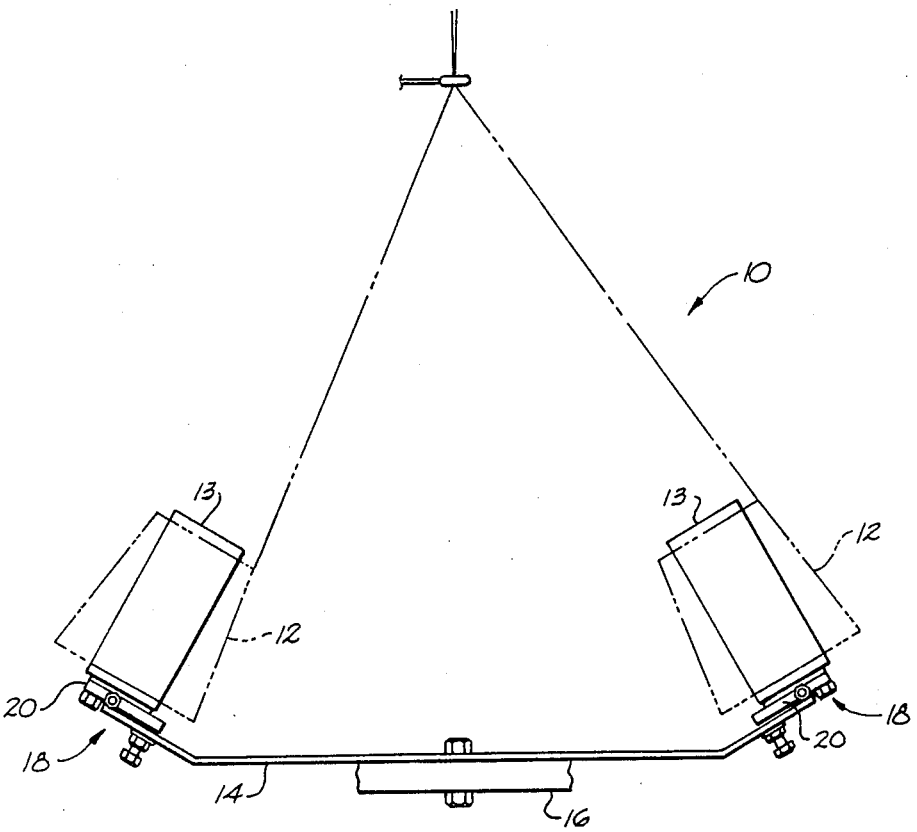
FIG. 1 is a diagramatic plan view of a yarn creel such as those used on outside filling supply looms.
Figure 2:
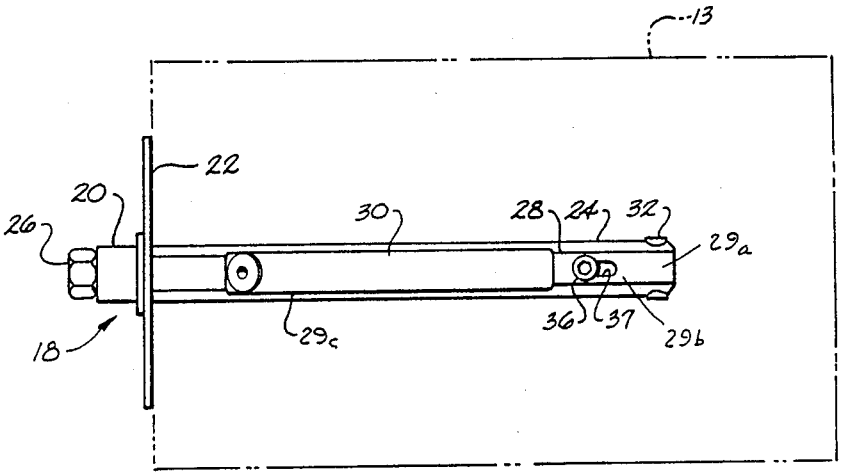
FIG. 2 is an enlarged detail plan view showing the yarn package support holder of the invention attached to the creel arm.

Referring now to FIGS. 1 and 2, there is shown a yarn creel 10, suitable for application to a textile machine such as an outside filling supply loom or a knitting machine, as desired. Creel 10 comprises a support arm 14 which is bolted to the frame 16 to retain it in place.

Two yarn packages 12 are wound onto tubes 13 and supported on yarn package holders 18 which are connected to support arm 14 by suitable bolts. The term "tube" as used herein means conical and cylindrical tubes of various lengths and diameters.

Referring now to FIGS. 3, 4, and 5 wherein is shown a specific embodiment of the holder of the invention. Holder 18 comprises a base support 20 in the form of an arm, which, in use, is attached to creel support arm 14. Extending from the base support 20 at approximately a ninety degree angle is a tube contact arm 24. A reduced portion of contact arm 24 extends through a support plate 22 and base support 20 and is secured rigidly in place by a nut 26 which is threaded onto the reduced portion of contact arm 24. Thus, contact arm 24 extends from base plate 22 and base support 20 in a cantilevered fashion.

As can be seen from the drawings, the contact arm, as illustrated, is hexagonal, but it will be understood that the configuration of the tube contact arm may be selected as desired as long as a surface which comes into contact with the inner surface of tube 13 extends generally at right angles to the longitudinal axis of the base support 20.

On the free end of the tube contact arm 24, a contoured package support arm is pivotally connected. Contoured package support arm 28 has a stepped configuration which permits it to be readily depressed by the insertion of a tube 13 thereon. The contoured package support arm is provided with a sleeve 30 of frictional material such as rubber in its curved portion which is designed to come into holding contact with the inside wall of tube 13.

Interposed between the tube contact arm 24 and the contoured package support arm 28, is a spring 34 which is held into place by a fixed shank of a fastener in the form of a machine screw 36 which extends through slot 37 in arm 28. Spring 34 normally urges contoured package arm 28 away from the tube contact arm 24 and into frictional contact with the inside wall of tube 13.

The contoured support arm 28 includes a nose portion 29 having an inclined yarn package guiding surface 29*a* which guides the package up and over screw 36, a biased bridge portion 29*b* and an outwardly bowed package engaging portion 29*c*. More particularly, slot 37 has sufficient length to allow relative movement of contoured arm 28 and the fixed shank of fastener 36 facilitating pivoting of the contoured arm 28. Bridge portion 29*b* contains slot 37 and bridges yarn package guiding surface 29*a* and bowed portion 29*c*. Yarn package guiding surface 29*a* guides a yarn tube over the head of fastener 36 and onto bowed portion 29*c* in a manner that enables one handed operation from an opposing side of the holder.

Where relatively small diameter tubes are utilized, as seen in FIG. 5, the tube contact arm comes directly into contact with the inside wall of the tube. However, when very large tubes are used, a spacer bar 38 is placed along side the tube support arm 24 and interposed between the tube support arm and the inside wall of the tube. Spacer bar 38 is held in place against the tube contact arm by means of a machine screw 40 and a pin 42 which maintains the appropriate alignment of the spacer bar with the tube contact arm.

In operation, the holder of the present invention will receive and secure yarn packages wound on various diameter tubes without any adjustment of the mechanism, as for example seen in FIG. 5. The surface of the tube contact arm 24 maintains the yarn package at a right angle to the base 22 so that the operator of the loom may adjust the orientation of the package on the loom and expect it to be maintained even under the conditions of vibration that exist on looms or weaving machines. The rigid connection of the tube contact arm to the base support arm assures this continued relationship between the yarn package and the base.

It has also been found that the same relationship can be maintained for much greater diameter tubes such as that shown in FIG. 4 by interposing a spacer bar 38 between the tube contact arm and the inside of the tube without sacrificing in any degree the rigidity of the yarn support and the continued proper orientation of the yarn package on the creel.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A holder for receiving and frictionally securing packages of yarn, wound onto hollow tubes of various inner diameters, comprising:

(a) a base support, adapted to be attached to a creel for a textile machine;

(b) a contact arm for contacting an inside wall of a yarn tube, one end of which is rigidly connected to said base support, said contact arm extending from said base support in a cantilevered manner;

(c) a contoured support arm, a pivot connecting one end of said contoured support arm to said contact arm at a point remote from the point where the end of said contact arm is rigidly connected to said base support and a distal free end extended in the direction of said base support terminating short thereof; and (d) resilient means interposed between said contact arm and said contoured support arm at a distance from said pivot towards said base support, said resilient means urging the end of said contoured arm which is remote from said pivot away from said contact arm in a manner that said contoured support arm and said contact arm are urged against opposite inside walls of a hollow tube placed about said contact arm and said contoured support arm to secure said hollow tube to the base support.

2. A yarn package holder as set forth in claim 1, wherein the portion of the contoured support arm which contacts the inside wall of the tubes is curved outwardly so as to present a firm contact against the inner wall of the hollow tube for tubes of various inner diameters.

3. A yarn package holder as set forth in claim 2 wherein, said curved contour arm is covered with a friction material.

4. A yarn package holder as set forth in claim 1, wherein said resilient means comprises a compression spring disposed about a fastener shank which passes freely through an elongated opening in the contoured support arm and is rigidly attached to said contact arm, and said elongated opening having a sufficient length to permit movement of said contoured support arm relative to said fastener shank in an axial direction along longitudinal axis of said contact arm.

5. A yarn package holder as set forth in claim 1, wherein a support plate is interposed between said contact arm and said base support and extends at a right angle to said contact arm.

6. A yarn package support as set forth in claim 1, wherein an elongated spacer bar is rigidly attached to said contact arm in a position which interposes it between said contact arm and said inner wall of said tube placed about the support.

7. A holder for receiving and frictionally securing packages of yarn, wound onto hollow tubes of various inner diameters, comprising:

(a) a base support, adapted to be attached to a creel for a textile machine;

(b) a contact arm for contacting an inside wall of said yarn tubes, one end of which is rigidly connected to said base support, said contact arm extending from said base support arm in a cantilevered manner including a spacer bar rigidly attached to one side of said contact arm having a surface for contacting the inside wall of said yarn tubes;

(c) a contoured support arm, a pivot connecting one end of said contoured support arm to said contact arm at a point remote from the point where the end of the contact arm is rigidly connected to said base support arm and wherein a plane taken through the longitudinal axis of said contoured arm also extends through the longitudinal axis of said contact arm and said spacer bar, with said contact arm being interposed between said spacer bar and said contour arm; and (d) resilient means interposed between said contact arm and said contoured support arm at a distance from said pivot towards said base support, said resilient means urging the end of said contoured support arm which is remote from said pivot, away from said contact arm, whereby said contoured support arm and said spacer bar are urged against inside walls of a hollow tube placed about said contact arm and said contoured support arm to secure said hollow tube against the base support.

8. A yarn package holder as set forth in claim 7, wherein the portion of the contoured support arm which contacts the inside wall of the tubes is outwardly curved so as to present a firm contact against the inner wall of the hollow tube for tubes of various inner diameters.

9. A yarn package holder as set forth in claim 8 wherein, said curved contour arm is covered with a friction material.

10. A yarn package holder as set forth in claim 7, wherein said resilient means comprises a compression spring disposed about a fastener shank which passes freely through an elongated opening in the contoured support arm and is rigidly attached to said contact arm for limiting outward movement of said contoured support arm, and said elongated opening having a sufficient length to permit movement of said contoured support arm relative to said fastener shank in an axial direction along longitudinal axis of said contact arm.

11. A yarn package holder as set forth in claim 7, wherein a support plate is interposed between said contact arm and said base support and extends at a right angle to said contact arm.

12. A yarn package holder as set forth in claim 7 wherein said contoured support arm includes an outward bowed portion for engaging said tube wall having a covering formed from a polymeric friction material which facilitates sliding of said yarn tube over said bowed portion and firm gripping of said inside tube walls once said yarn tube is received into place.

13. A textile yarn package holder for receiving and frictionally securing packages of yarn wound onto a hollow tube comprising:

(a) a base support, adapted to be attached to a support of an associated textile machine;

(b) a contact arm for contacting an inside wall of a yarn tube, one end of which is rigidly connected to said base support, said contact arm extending from said base support in a cantilevered manner;

(c) a contoured support arm, a pivot connecting one end of said contoured support arm to said contact arm at a pivot point remote from the point where the end of said contact arm is rigidly connected to said base support arm;

(d) said contoured support arm including an outwardly bowed portion for gripping an inside wall of said yarn package tube, and a nose portion having an inclined tube guiding surface extending from said pivot for guiding said yarn package tube onto said outwardly bowed portion; and (e) resilient means interposed between said contact arm and said contoured support arm at a distance from said pivot towards said base support, said resilient means urging the end of said contoured arm which is remote from said pivot, away from said contact arm, whereby said outwardly bowed portion of said contoured support arm and said contact arm are urged against opposite inside walls of said hollow tube placed about said contact arm and said contoured support arm to secure said hollow tube to the base support.

14. The holder as set forth in claim 13, wherein said contoured support arm includes a bridge portion bridging said nose portion and said outwardly bowed portion, said bridge portion having an elongated opening receiving a fixed shank of a fastener interconnecting said contact arm and said contoured arm and said bridge portion connecting said nose portion and outwardly bowed portions in a manner that said yarn tube is guided over said fastener for placement upon said holder.

15. The holder as set forth in claim 14 wherein said elongated opening extends in the direction of the longitudinal axis of said contoured support arm and has a sufficient length to allow said contoured support arm to move relative to said fixed shank in the axial direction facilitating pivotal movement of said contoured support arm.

16. The holder as set forth in claim 14 including a covering of a friction material carried on said outwardly bowed portion.

* * * * *